United States Patent [19]

Davis

[11] 4,132,448

[45] Jan. 2, 1979

[54] METHOD OF RECOVERING COAL IN AQUEOUS SLURRY FORM

[75] Inventor: Bruce W. Davis, Fullerton, Calif.

[73] Assignee: Chevron Research Company, San Francisco, Calif.

[21] Appl. No.: 831,035

[22] Filed: Sep. 6, 1977

[51] Int. Cl.[2] ..... B02C 19/00; E21C 41/04

[52] U.S. Cl. ..... 299/5; 241/1

[58] Field of Search ..... 299/5, 2–4, 299/16; 241/1; 166/307; 44/1 B

[56] References Cited

U.S. PATENT DOCUMENTS

| | | | |
|---|---|---|---|
| 1,532,826 | 4/1925 | Lessing | 299/5 |
| 3,815,826 | 6/1974 | Aldrich | 241/1 |
| 3,850,477 | 11/1974 | Aldrich et al. | 299/5 |
| 3,918,761 | 11/1975 | Aldrich | 299/5 |
| 4,023,193 | 6/1977 | Drinkard et al. | 299/4 |

*Primary Examiner*—Stephen J. Novosad

*Attorney, Agent, or Firm*—R. L. Freeland, Jr.; Edward J. Keeling

[57] ABSTRACT

A method of in-situ coal recovery in slurry form from a coal deposit by first contacting the coal with a gaseous mixture of an oxygen-containing gas containing vaporized $NO_2$, then with an aqueous alkaline solution to slurry the coal, and then recovering the slurried coal from the deposit.

9 Claims, 3 Drawing Figures

METHOD OF RECOVERING COAL IN AQUEOUS SLURRY FORM

FIELD OF THE INVENTION

The invention provides a method for in-situ recovery of lignitic, sub-bituminous and bituminous coal in slurry form by first contacting the coal in situ in a formation with a gaseous mixture of an oxygen-containing gas and vaporized $NO_2$ to cause the gaseous mixture to react with the coal. The reacted coal is then contacted with an aqueous caustic solution to break up and slurry the coal. The slurried coal is then removed from the formation for surface processing.

BACKGROUND OF THE INVENTION

In the past, various methods have been suggested to recover coal in situ by slurrying the coal. Some of these techniques are taught in the following U.S. Pat. Nos. 1,532,826, 3,260,548, 3,359,037 and 4,032,193. U.S. Pat. No. 4,032,193 discloses a process for treating coal in-situ with a basic aqueous solution, preferably sodium hydroxide, to disintegrate the coal. The patent states that either mechanical enlargement of the wellbore in the vicinity of alkali injection or removal of some of the initially disaggregated coal is necessary to provide adequate porosity. The patent also suggests that the coal may be contacted with a reactive oxygen-containing substance. There is still need, however, for a process of slurrying coal in-situ which minimizes need for mechanical operations down the well.

BRIEF DESCRIPTION OF THE INVENTION

The invention provides a method for in-situ recovery of lignitic, sub-bituminous and bituminous coal in aqueous slurry form by first contacting the coal in situ in a formation with a gaseous mixture of an oxygen-containing gas containing vaporized $NO_2$ to cause the gaseous mixture to react with the coal to provide permeability in the coal seam. The coal in the formation is then contacted with an aqueous alkaline solution to break up and slurry the coal. The slurried coal is then removed from the formation to the surface.

The present invention provides a method for recovering lignitic, sub-bituminous or bituminous coal in slurry form from an underground lignitic, sub-bituminous or bituminous coal-containing formation. A flow path is established from the earth's surface to the coal-containing formation. A gaseous mixture of an oxygen-containing gas containing at least one volume percent $NO_2$ is directed through the flow path to contact the coal contained in the formation adjacent the flow path and reacted therewith at a temperature of from about 20° C. to about 90° C. to provide permeability in the coal. An aqueous alkaline solution containing from 0.5% to 5.0% by weight $NH_3$ is injected through the flow path, to contact the coal contained in the formation adjacent the flow path to break up and slurry the coal. The slurried coal is removed from the formation to the earth's surface through the flow path. In accordance with the invention, the oxygen content of the oxygen-containing gaseous mixture may be adjusted through a broad range. Thus, an inert gas such as nitrogen may be used with air to lower the oxygen content of the gaseous mixture to less than 20 volume percent oxygen. The lower oxygen content will result in less rapid reaction of the coal. In other instances, much higher values of oxygen in the gaseous mixture are desirable. In one form of the invention, the aqueous $NH_3$ solution containing from about 0.5% to 5.0% by weight $NH_3$ also contains from about 0.01 to 0.2% by weight of NaOH or from about 0.014 to 0.28% by weight of KOH.

PRINCIPAL OBJECT OF THE INVENTION

The principal object of the present invention is to recover lignitic, sub-bituminous or bituminous coal in slurry form from an underground coal-containing formation utilizing a moderate temperature and pressure reaction between the coal and a gaseous mixture of an oxygen-containing gas including at least one volume percent $NO_2$ followed by an aqueous alkaline solution to slurry the coal. Further objects and advantages of the present invention will become apparent from a careful reading of the following detailed description of the present invention in view of the drawings which are incorporated herein and made a part of this specification.

DETAILED DESCRIPTION OF THE INVENTION

Figure 1:
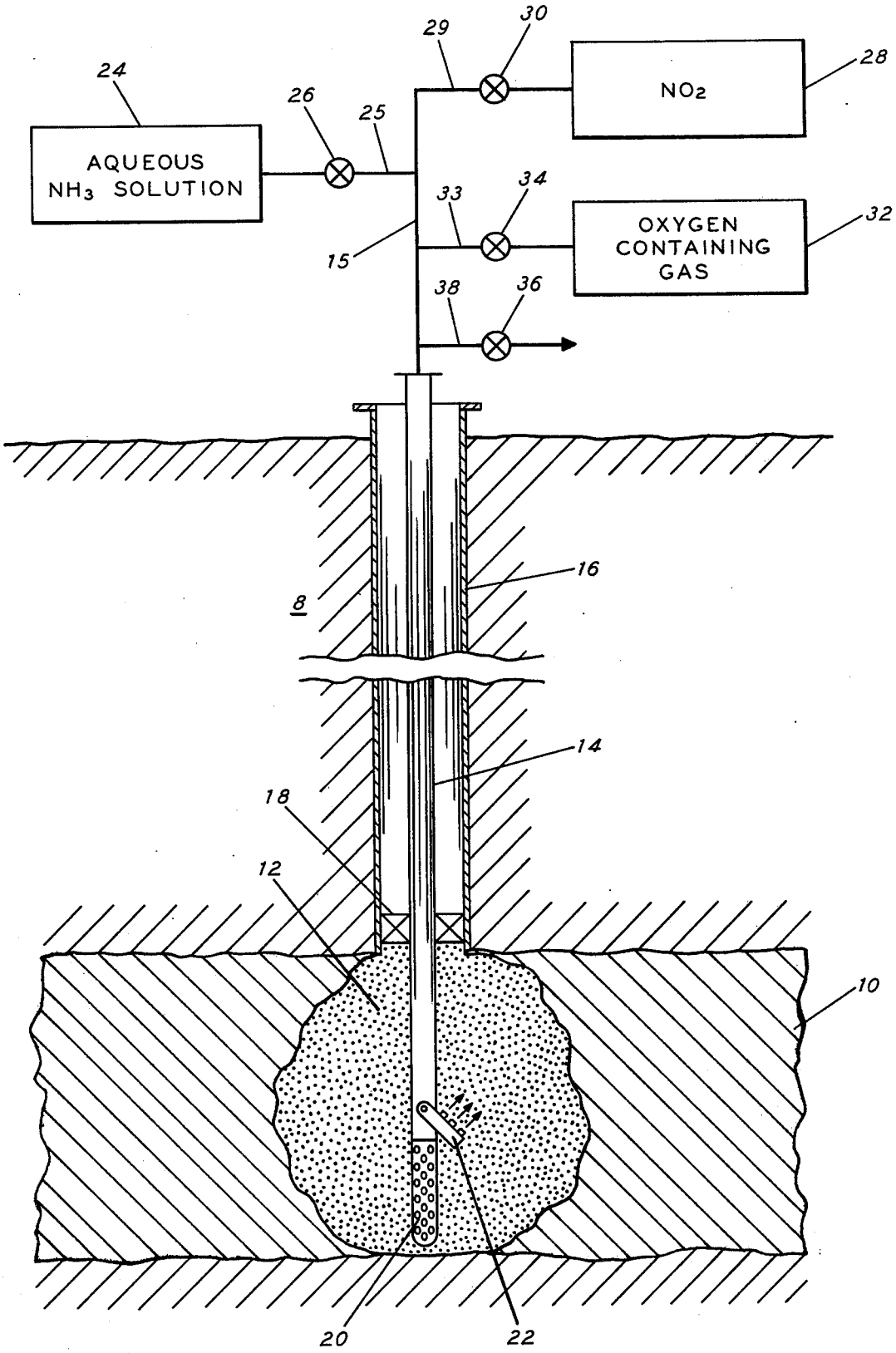
FIG. 1 is a schematic elevation view illustrating the preferred embodiment of the present invention.

FIG. 1 is a schematic elevation view illustrating a coal seam 10 being processed by the method of the present invention. A cavity 12 has been formed in the coal seam adjacent the lower end of a well 16. The well 16 provides a flow path from the earth's surface through the overburden 8 to the coal seam 10 for the reactive agents in accordance with the invention. Thus, tubing string 14, having a suitable injection device 22 near its lower end, is connected to sources of an oxygen-containing gas 32, $NO_2$ 28, and aqueous $NH_3$ solution 24 through suitable flowlines 25, 29, 33 and 15 and control valves 26, 30 and 34. Coal in slurry form may also be recovered up tubing string 14 through pump 20 to surface recovery line 38 and control valve 36.

In accordance with the present invention, a lignitic, sub-bituminous or bituminous coal-containing formation is first contacted with an oxygen-containing gaseous mixture which includes at least one volume percent of vaporized $NO_2$. The vaporized $NO_2$ reacts with the coal and chemically breaks down the coal. Since the $NO_2$ is maintained in the gaseous state, it is not necessary to extensively rubblize the coal by pretreatment, such as, for example, explosive or hydraulic fracturing. The gaseous mixture of $NO_2$ and oxygen-containing gas is contacted with the coal in situ. This is done by establishing a flow path into the coal formation as, for example, by drilling a conventional well from the earth's surface into the coal-containing formation. The gaseous $NO_2$-oxygen mixture is then injected down the well to contact and react with the coal in the formation adjacent the well. The gaseous $NO_2$-oxygen mixture penetrates into the pores and along grain boundaries, allowing the reaction to proceed through the formation away from the well. When the reaction between the $NO_2$-oxygen containing gaseous mixture has proceeded to a desired extent, an alkaline solution such as an aqueous $NH_3$ solution containing from 0.5% to 5.0% by weight $NH_3$ is injected down the well to contact the coal adjacent thereto. The aqueous $NH_3$ solution breaks up and slurries the gas-treated coal adjacent to the well. The slurry thus formed is lifted to the surface.

Figure 2:
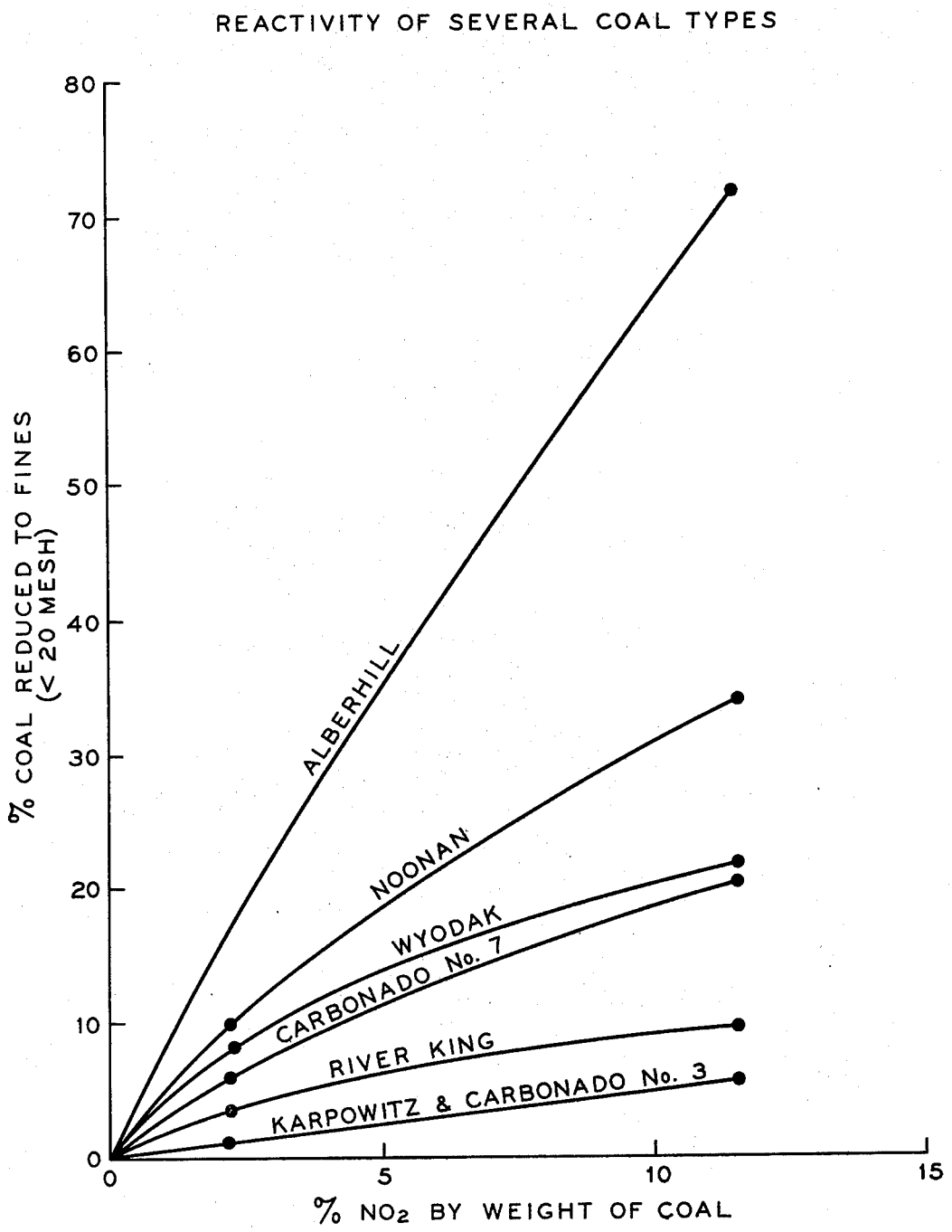
FIG. 2 shows plots of the reactions of several coal types with $NO_2$ and $O_2$.

FIG. 2 shows the reactivity of several coal types with $O_2$ and varying amounts of $NO_2$. The coals rank from lignitic through sub-bituminous to bituminous. The Alberhill is a lignitic type, and can be readily reduced to fines after reaction with an $NO_2$-$O_2$-containing mixture. The Karpowitz and Carbonado #3, both bituminous coals, react much less actively with $NO_2$ and $O_2$. All the coals shown in FIG. 2 are candidates for recovery in accordance with the present invention. Reaction of the various types of coal shown in FIG. 2 was carried out in a fixed-bed reactor utilizing native coal sized from 5 to 10 mesh. Approximately 100 grams were used in each case. The samples were preflushed with $O_2$ at 20 cc/min (18 psia at 24° C.). The $NO_2$ vapor was then transferred over a 120-minute period with $O_2$ stream flowing at 10 cc/min. The $NO_2$-$O_2$ -treated samples were then given a alkaline leach using a solution containing 0.75% $NH_3$ and 0.08% NaOH. The percent reduced to fines shown in FIG. 2 is determined by the calculated dry weight loss of 8-g samples of coal leached from 20-mesh bags suspended in an alkaline solution for 24 hours. The differences among the various coals are a relative measure of the susceptibility of the different coals to the process. Excess amounts of $O_2$ and $NO_2$ were used in these tests.

Figure 3:
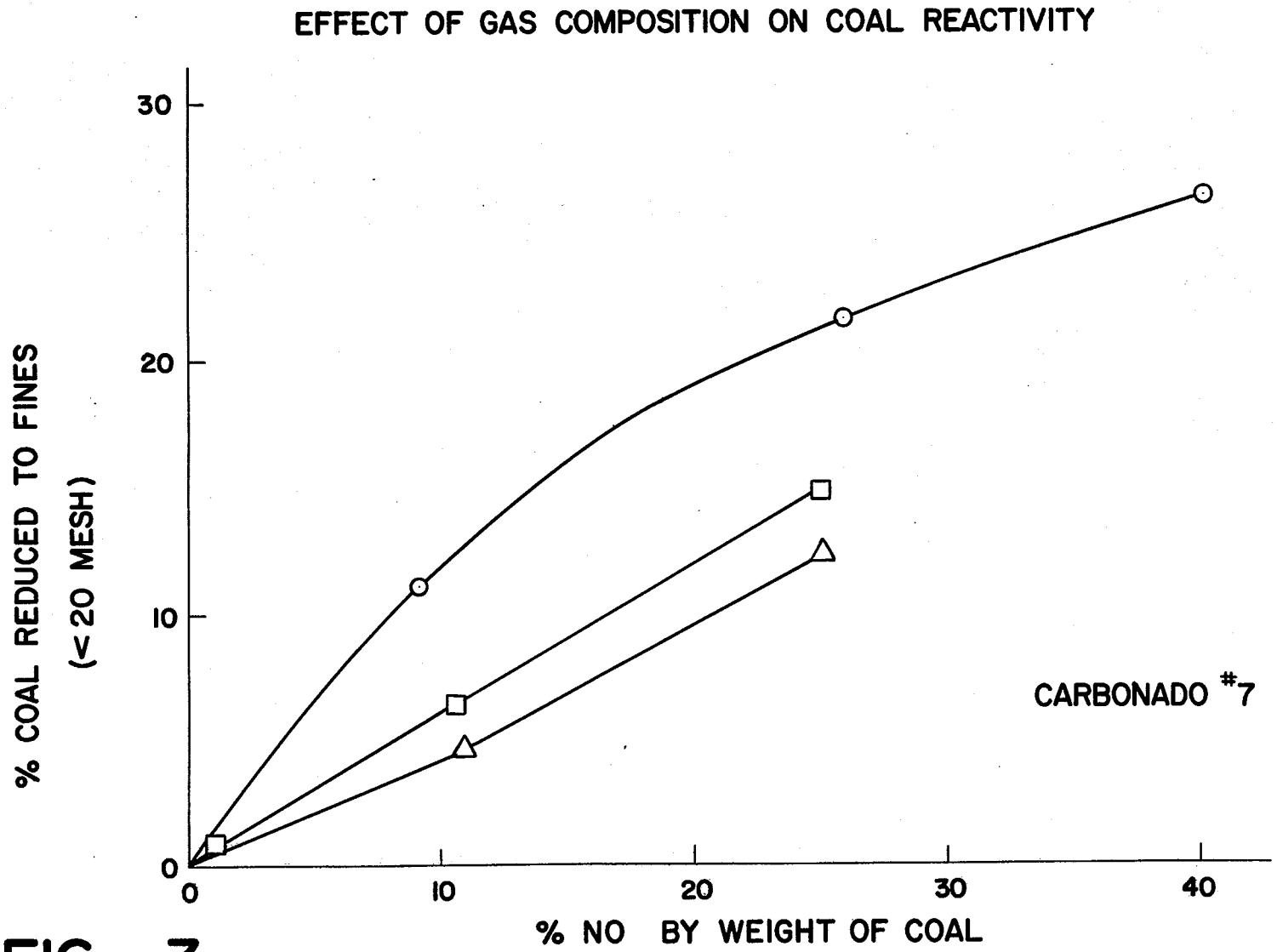
FIG. 3 shows plots of the reaction of a coal with mixtures of $NO_2$ and various gases.

FIG. 3 illustrates the reactivity of Carbonado #7 coal with mixtures of $NO_2$ and various gases. Thus, pure oxygen, air and nitrogen mixed with $NO_2$ were contacted with the coal to determine the effectiveness of the different gas mixtures. The text procedure for evaluating Carbonado #7 coal was essentially the same as that used in connection with FIG. 2. In the present tests, 160-g sampls were preflushed with $O_2$, air or $N_2$ for 30 minutes at 60 cc/min (18 psia, 24° C.). The $NO_2$ vapor was then transferred during a 120-minute period, maintaining $O_2$, air or $N_2$ flow at 20 cc/min. A post-flush with the $O_2$, air or $N_2$for 60 minutes at 60 cc/min followed the $NO_2$ transfer. The alkaline leach was carried out as described in FIG. 2.

The gaseous $NO_2$-oxygen-containing mixture contains at least about one volume percent $NO_2$. In operation, it may often be desirable to increase the concentration of $NO_2$ in the gaseous mixture to a higher value to increase the reaction with the coal to provide greater permeability in the coal seam. The upper limit of the concentration of $NO_2$ is determined by the amount of $NO_2$ that can be maintained in vapor phase under surface operating conditions. To avoid condensation of $NO_2$, its concentration in the mixture must be limited. For example, at -6.6° C., the $NO_2$ cannot exceed 10% by volume and at 21° C. the $NO_2$ cannot exceed 30% by volume. The oxygen content of the gaseous mixture may vary through a broad range. It is desirable to have at least some oxygen in the mixture; thus as little as 5% $O_2$ may be used and the mixture completed with an inert gas such as nitogen. In some formations, it may be desirable to first contact the coal with an oxygen-containing gas alone (i.e., without $NO_2$) for a period before injecting the $O_2$-$NO_2$ mixture. In certain instances, the oxygen content of the gaseous mixture may be adjusted during field operation to slow down or speed up the reaction. A indicated, lower oxygen content tends to slow the reaction, while higher oxygen content accelerates the reaction. Reaction temperature can be controlled by adjusting the $NO_2$ and/or $O_2$ content and flow rate.

The gaseous $NO_2$-oxygen mixture is usually contacted with coal in situ by injecting the gaseous mixture down a well drilled into the coal seam from the earth's surface. Injection pressure is not allowed to exceed the fracture pressure of the formation The gaseous $NO_2$-oxygen-containing mixture reacts chemically with the coal and increases the permeability of the coal. Injectivity is thus enhanced and additional gaseous mixture contacts coal away from the well. After the desired portion of the coal seam has been reacted, gas injection is terminated and the coal is ready for slurrying in the aqueous alkaline solution.

The aqueous alkaline solution is preferably circulated down the well to slurry the coal adjacent the well, and the slurried coal is lifted to the surface. The aqueous alkaline solution should contain from about 0.5% to about 5.0% by weight $NH_3$. The slurrying action of the solution can be assisted by adding from about 0.01 to 0.2% by weight of NaOH or from about 0.014 to 0.28% by weight of KOH.

Although specific embodiments have been described herein, the invention is not meant to be limited to only such embodiments, but rather by the scope of the appended claims.

What is claimed is:

1. A method for recovering lignitic, sub-bituminous or bituminous coal in slurry form from a coal-containing formation comprising establishing a flow path from the earth's surface to a lignitic, sub-bituminous or bituminous coal-containing formation, flowing through said flow path a gaseous mixture containing up to 99 volume percent oxygen and at least about one volume percent $NO_2$, up to an amount of $NO_2$ that will remain in vapor phase in said gaseous mixture, and contacting said coal-containing formation with said gaseous mixture to cause a reaction with the coal is said formation adjacent said flow path, flowing an aqueous alkaline solution through said flow path to contact the coal contained in said formation to break up and slurry the coal, and lifting the coal in slurry form from said formation to the earth's surface.

2. The method of claim 1 further characterized in that the aqueous alkaline solution contains from 0.5% to 5.0% by weight $NH_3$.

3. The method of claim 2 further characterized in that the aqueous $NH_3$ solution contains about 0.01% to 0.2% by weight of NaOH.

4. The method of claim 2 further characterized in that the aqueous $NH_3$ solution contains from about 0.014% to 0.28% by weight of KOH.

5. The method of claim 1 further characterized in that the oxygen content of the gaseous mixture is at least about 20% by volume.

6. The method of claim 1 further characterized in that an oxygen-containing gas alone is contacted with the coal prior to contacting the coal with said gaseous mixture.

7. The method of claim 6 wherein the oxygen-containing gas is air.

8. The method of claim 6 wherien the oxygen-containing gas is oxygen.

9. The method of claim 1 further characterized by sequentially repeating the steps of contacting coal with said gaseous mixture and contacting the coal with said aqueous alkaline solutions.

* * * * *